United States Patent [19]

McLeod

[11] Patent Number: 4,632,183

[45] Date of Patent: Dec. 30, 1986

[54] INSERTION DRIVE SYSTEM FOR TREE SAVERS

[76] Inventor: Roderick D. McLeod, 5104 125th St., Edmonton, Alberta, Canada, T6H 3V5

[21] Appl. No.: 678,253

[22] Filed: Dec. 5, 1984

[30] Foreign Application Priority Data

Jan. 9, 1984 [CA] Canada ..... 444889

[51] Int. Cl.[4] ..... F21B 19/00

[52] U.S. Cl. ..... 166/77; 166/80; 254/29 R

[58] Field of Search ..... 166/85, 80, 77, 77.5, 166/379; 175/162, 170; 254/29 R, 29 A, 30, 31, 103, DIG. 2; 74/89.15, 424.8 R; 100/290

[56] References Cited

U.S. PATENT DOCUMENTS

| | | | |
|---|---|---|---|
| 131,746 | 10/1872 | Dubois | 254/29 R |
| 703,251 | 6/1902 | Haire | 254/30 |
| 1,498,062 | 6/1924 | Albaugh | 254/29 R |
| 1,895,132 | 1/1933 | Minor | 166/77 |
| 1,984,230 | 12/1934 | Otis | 166/77 X |
| 2,455,736 | 12/1948 | Conley | 252/263 X |
| 2,983,159 | 5/1961 | Zeligowsky et al. | 74/89.15 X |
| 3.757.858 | 9/1973 | Davis et al. | 166/77 |
| 3,911,810 | 10/1975 | Standbridge | 100/290 |
| 4,387,635 | 6/1983 | Abbestam et al. | 100/214 |

FOREIGN PATENT DOCUMENTS

| | | | |
|---|---|---|---|
| 1094945 | 5/1978 | Canada | 43/26 |

*Primary Examiner*—James A. Leppink
*Assistant Examiner*—David J. Bagnell
*Attorney, Agent, or Firm*—Hubbard, Thurman, Turner & Tucker

[57] ABSTRACT

An insertion drive system for a well head tree saver includes a pair of parallel, spaced beams, a lower one of which is attached to the tree. High pressure tubing is held by the upper beam and is inserted into or withdrawn from the tree by motor driven mechanical jack assemblies which lower or raise the upper beam relative to the lower beam. Manual operation of the jack assemblies is also provided.

5 Claims, 4 Drawing Figures

INSERTION DRIVE SYSTEM FOR TREE SAVERS

This invention relates to what is commonly known in the art as well head christmas trees and in particular to an insertion drive system for a tree saver.

Drive systems for inserting high pressure tubing for example through a master valve or set of valves of a christmas tree into the area of the casing head, are well known, one example being shown in Canadian Pat. No. 1,094,945. Typically, the drive system includes one or a pair of hydraulic rams one end of which is secured to the casing head, the other end forming a part of the insertion mechanism. While the existing, hydraulic drive systems generally function in a satisfactory manner, there are several draw backs to these existing systems. For example, hydraulic cylinders do not always move equally which can cause bending of piston rods and high pressure tubing. Hydraulic cylinders also have seals which can leak and cause movement problems and sometimes complete failure of the system. A break in a hydraulic cylinder line can be catastrophic and the high pressure tube to be inserted in the casing head can be blown out of the christmas tree. Loss of hydraulic power renders a hydraulic cylinder inoperational and hydraulic systems in general are prone to catching fire, if anything leaks while flames are present.

The drive systems according to the present invention provide substantial improvements in the art and incorporate mechanical screw jack assemblies to move the insertion system into or out of the christmas tree apparatus. The screw jack assemblies advance precisely as they are supplied with a rotary cranking motion and as they have no seal or pressures involved in their operation, they are inherently safe. Moreover, screw jacks are self-locking if the motive force used to operate them ceases to function and such loss of motor power can be overcome through the use of manual means such as a hand crank. Further, screw jack arrangements can be operated by pneumatic, electric or hydraulic motors in unsafe conditions.

According to a broad aspect, the present invention relates to a drive system for inserting tubing or the like into a well head tree, the system comprising a first beam attached to the christmas tree, the second beam parallel to and spaced above the first beam, means securing the tubing to the second, upper beam and a pair of mechanical jack assemblies interconnecting the beams and means for actuating the assemblies for moving the second, upper beam toward the first, lower beam.

The invention is illustrated by way of example in the accompanying drawings in which.

Figure 1:
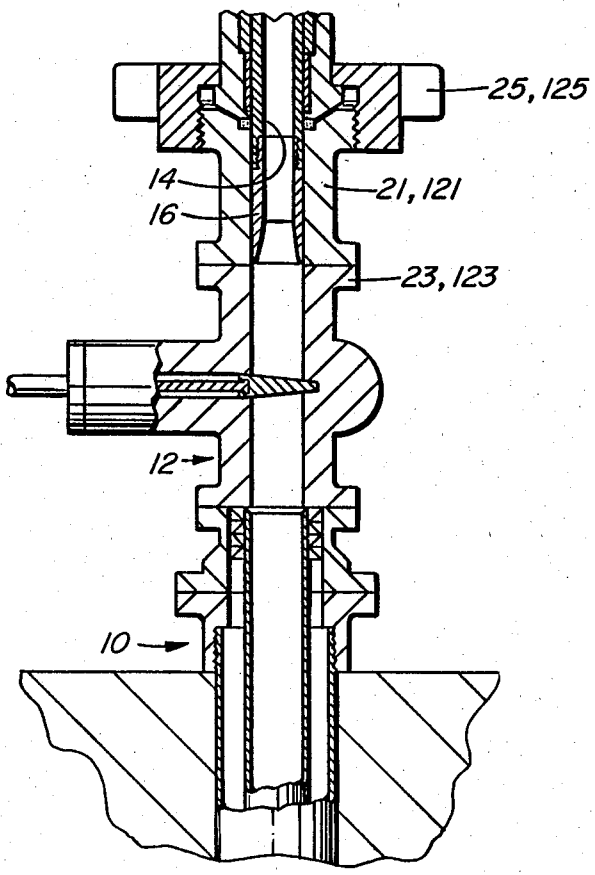
FIG. 1 is a sectional view of a well casing head showing a typical christmas tree master valve.

By inserting high pressure tubing or a mandrel and pack-off nipple, as shown is FIG. 1, through the master valve or set of valves into the area of the casing head, fluids etc. are allowed to be pumped through an upper, remote valve, through the christmas tree without contacting the internal parts thereof.

Figure 2:
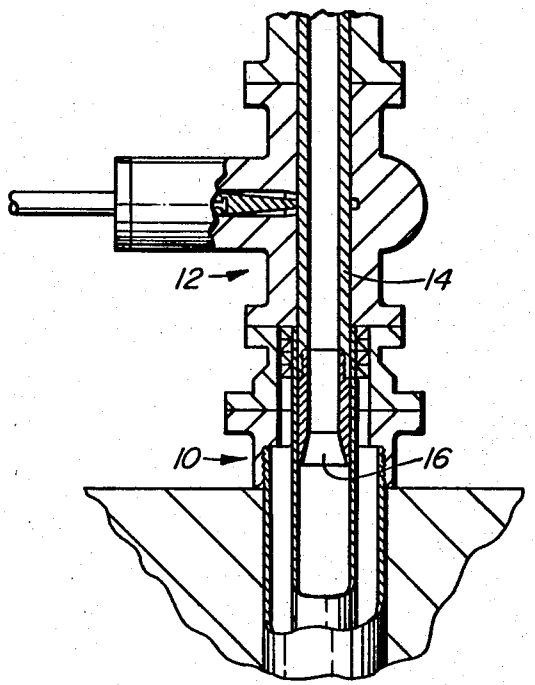
FIG. 2 is a view similar to FIG. 1 but showing a nipple being inserted into the tree arrangement.
Figure 3:
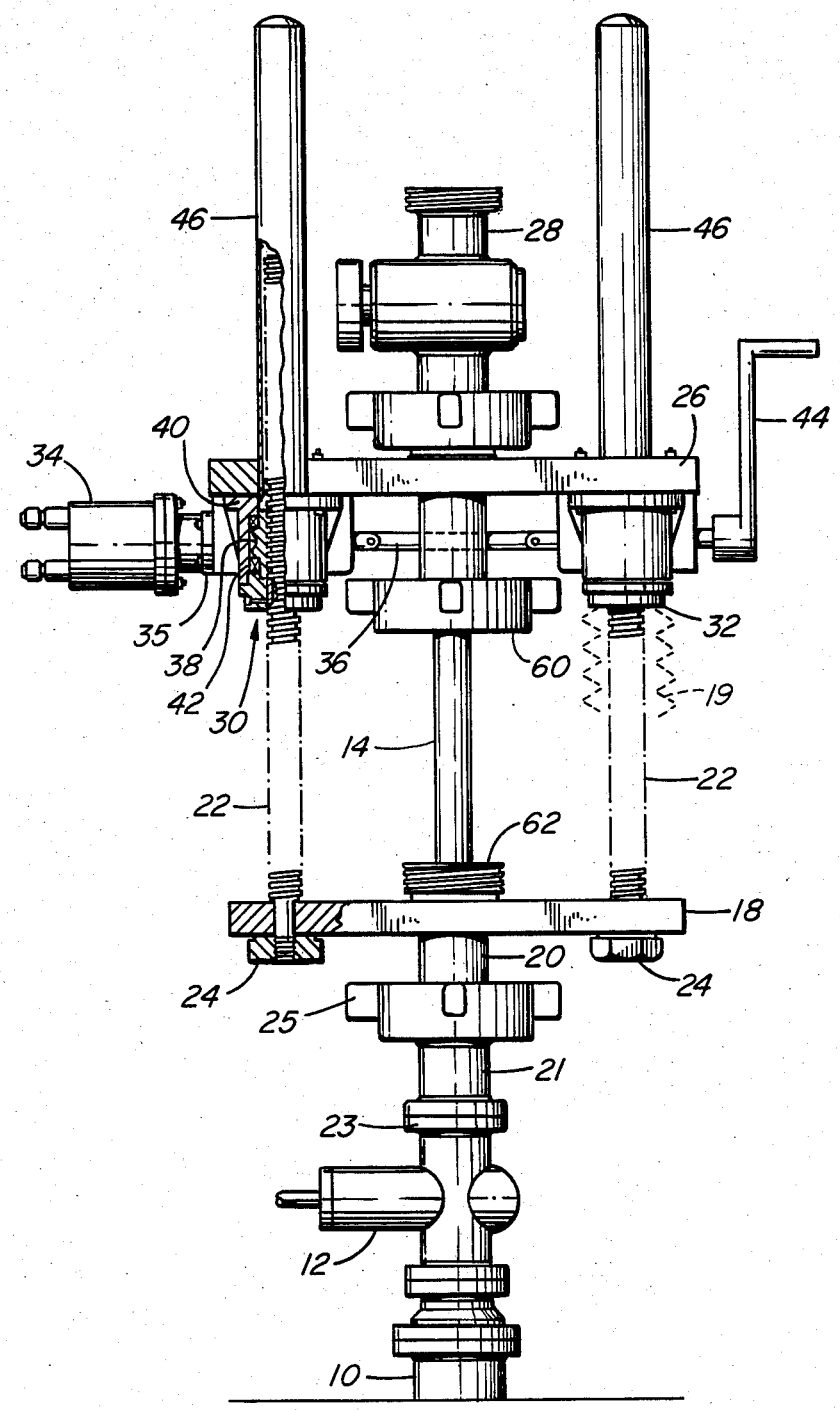
FIG. 3 is an elevation view, partly in section, of one embodiment of the drive system according to the invention.

Referring to FIG. 1, the casing head 10 has a master valve 12 secured to the upper end thereof. As shown in FIG. 1, the master valve 12 is in a closed position and a mandrel tube 14 with a nipple 16 on the lower end thereof is about to be inserted into the casing head 10. As shown in FIG. 2, the valve 12 is opened and the drive system of the present invention lowers the mandrel tube 14 and its nipple 16 down through the valve apparatus. Turning to FIG. 3, one embodiment of the drive system according to the invention includes a first or lower beam 18 is rigidly attached to a sleeve 20 of the apparatus. An adapter 21 is secured to the wellhead valve tree at flange 23, and nut 25 secures the tree saver to the adapter 21. One, two or any multiple of offset precision screws 22 (two being illustrated) are rigidly secured to the beam 18 such as by nuts 24.

A second, upper beam 26 is spaced from and located parallel with the lower beam 18 and the upper beam 26 securely retains the mandrel tube high pressure tubing 14, top remote valve 28 and a pair of jack assemblies 30 and 32 secured to the upper beam. As illustrated, a motor means 34 which can be operated hydraulically, pneumatically or electrically, is secured to the drive of one of the jack assemblies, 30 by means of an adaptor 35, a shaft 36 taking the drive to the second jack assembly 32.

A female screw gear 38 is mounted in a housing 40 by means of bearings 42 and engages the threads of shafts 22, gear 38 being rotated by the motor means 34. A manually operated crank 44 can be used to actuate the device if motor failure should occur.

In operation, the motor means 34 drives the female screw gear 38 on the surface of the shaft 22. Because the screw 38 is restrained from moving out of its housing 40, the housing and beam 26 move downwardly. The shaft 36 transmits the rotational movement to the second jack assembly 32 causing the beam 26 to move downward with equal force on both sides, the mandrel tube 14 being lowered into the christmas tree valve assembly as a result.

If power to the motor means 34 should fail, the manual crank 44 can be used to operate the jack assemblies. The upper ends of the threaded shaft 22 are provided with tubular covers 46 for protection.

Figure 4:
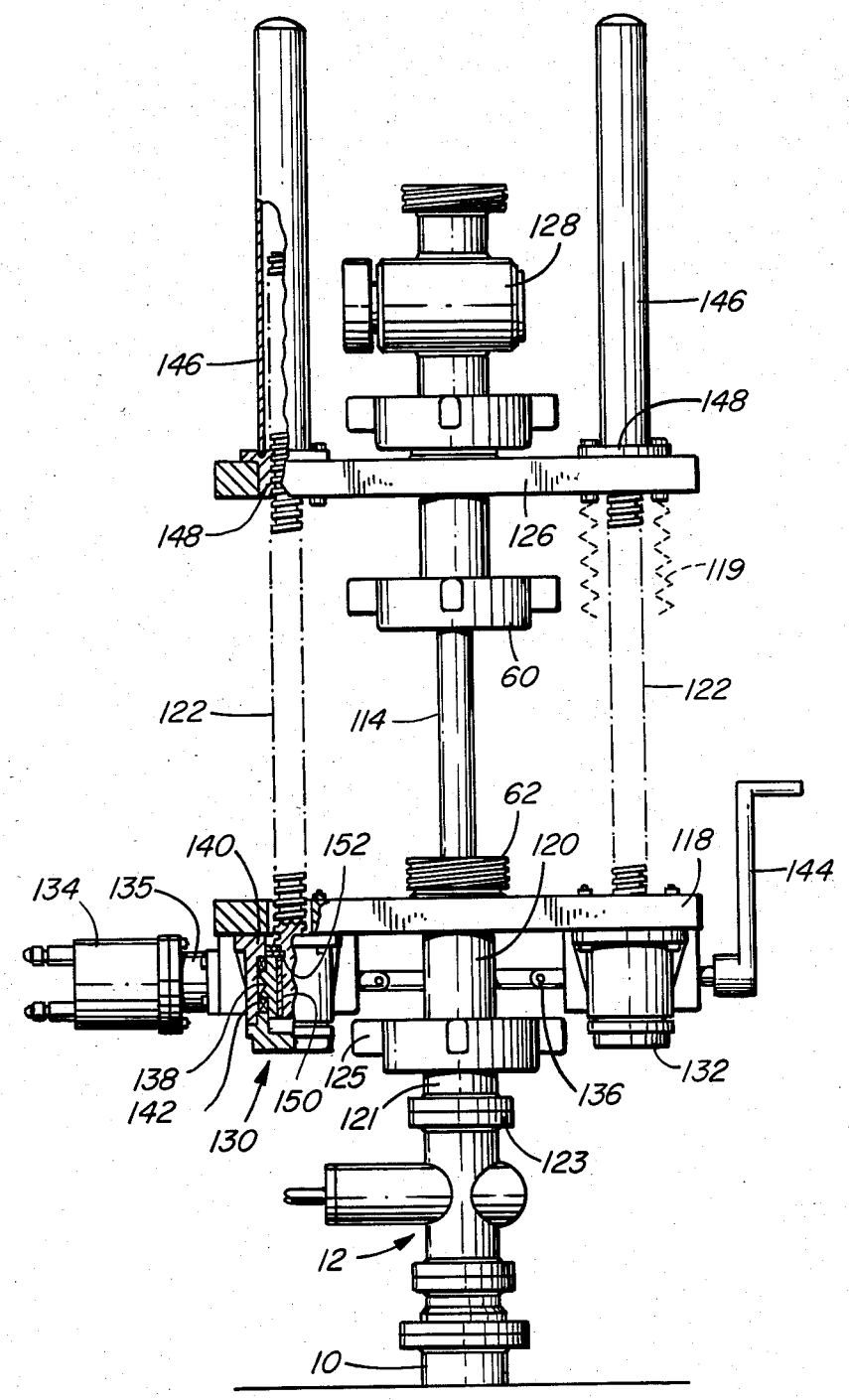
FIG. 4 is an elevation view also partly in section of another embodiment of the invention.

In the embodiment of FIG. 3, the threaded shafts 22 are stationary, the drive means being mounted on the upper beam and actuation of the motor means serving to lower the upper beam and the assembly it carries. In the embodiment of FIG. 4, the threaded shafts are free to rotate, the drive means being secured to the lower beam.

Turning now to FIG. 4, lower beam 118 is again secured to a sleeve 120 that is mounted on an adaptor 121 by nut 125, adapter 121 being secured to flange 123 of the wellhead valve tree. The upper beam 126 is spaced above and parallel to the lower beam. The jack assemblies 130 and 132 are secured to the bottom surface of the lower beam 118 and connected to motor means 134 by way of an adaptor 135. The shafts 122 are free to rotate in the beams 118 and 126, the latter including captive nuts 148 rigidly secured thereto and threadably engaging the outer surface of the shaft 122. As in the previous embodiment, the upper beam 126 carries the upper valve 128 and the mandrel tubing 114. Valve 28 or 128 can be located away from the tree saver and a flexible steel line, not shown, can connect the valve to the top of the tree saver.

The female screw gear 138 is secured to the lower end of the shaft 122 by means of a key 150 and pin 152. Accordingly, the threaded shafts 122 are secured to beams 118 but are free to rotate.

As motor means 134 rotates the shafts 122 the interaction between the upper ends of the shafts and the captive nuts 148 cause the upper beam 126 and its supporting apparatus to move downwardly to insert the tube 114 through the christmas tree.

In either embodiment, once the tube 114 has been lowered to its desired position a lock ring 60 threadably engages a screw collar 62 to lock the tree saver mandrel tube 114 in place. Flexible sleeves 19, 119 may be used on the shafts 22, 122 respectively to inhibit the ingress of moisture, dirt, etc.

While a pair of jack assemblies has been illustrated in these embodiments a single jack system is possible but would prove to be very cumbersome.

Therefore, while the invention has been described in connection with specific embodiments thereof and in a specific use, various modifications will occur to those skilled in the art without departing from the spirit and scope of the invention as set forth in the appended claims.

The terms and expressions used in this specification are so used as terms of description and not of limitation. There is no intention in the use of such terms and expressions to exclude any equivalence of the features shown and described or portions thereof. It is recognized that various modifications are possible within the scope of the invention claimed.

The embodiments of the invention in which an exclusive property or privilege is claimed are defined as follows:

1. A drive system for inserting a mandrel tube into a well head tree saver, said system comprising:

a pair of spaced beam members including a first, lower beam member adapted to be mounted onto said tree saver and through which said mandrel tube is to be inserted;

a second, upper beam member parallel to and spaced above said first lower beam member;

a pair of mechanical jack assemblies interconnecting said upper and lower beam members and comprising a pair of parallel threaded shafts, one adjacent each end of said beam members and extending therebetween;

means on one of said beam members engaging the threads on said shafts;

an interconnected, double gear drive means, one engaging each of said jack assemblies, for moving said upper beam member relative to said lower beam member;

said mandrel tube being secured in said upper beam member and adapted to be driven into or out of said lower beam member and said tree saver in response to movement of said upper beam member by said jack assemblies; and means on the upper and lower beam members for releasably locking the mandrel tube in place when said upper beam member has been moved to its lower position by said drive means.

2. A drive system according to claim 1 including motor means engaging and actuating said interconnected, double gear drive means and crank means engaging said interconnected double gear drive means for manual operation thereof.

3. A drive system according to claim 1 wherein said parallel threaded shafts are stationary, the lower ends thereof being secured against rotation in said first, lower beam member, said drive means being secured to the second, upper beam member whereby actuation thereof causes said upper beam member to travel along said stationary threaded shafts toward or away from said lower beam member.

4. A drive system according to claim 1 wherein said jack assemblies and drive means are mounted on the lower beam member; said threaded shafts of said assemblies being rotatable by said drive means and having their lower ends engaged by said double gear drive means; and captive nuts in the upper beam member threadably engaged by said shafts whereby actuation of the drive means rotates said shafts and moves the upper beam member toward or away from the lower beam member.

5. A drive system according to claim 1 wherein said releasable locking means comprises a threaded collar secured to one of said beam members and a rotatable nut mounted on said other beam member; said collar and nut being concentrically located with and surrounding said mandrel tube.

* * * * *